United States Patent [19]

Storandt et al.

[11] 4,307,895

[45] Dec. 29, 1981

[54] SKI SAFETY BINDING

[75] Inventors: Ralf Storandt; Manfred Richert, both of Leonberg, Fed. Rep. of Germany

[73] Assignee: Vereinigte Baubeschlag-fabriken Gretsch & Co. GmbH, Leonberg, Fed. Rep. of Germany

[21] Appl. No.: 67,359

[22] Filed: Aug. 17, 1979

[30] Foreign Application Priority Data

Sep. 6, 1978 [DE] Fed. Rep. of Germany ..... 2838903

[51] Int. Cl.[3] ..... A63C 9/084

[52] U.S. Cl. ..... 280/632

[58] Field of Search ..... 280/632, 631, 634, 626, 280/628

[56] References Cited

U.S. PATENT DOCUMENTS

| | | | |
|---|---|---|---|
| 3,291,500 | 12/1966 | Vöster et al. | 280/632 |
| 3,689,097 | 9/1972 | Smolka et al. | 280/631 |
| 3,933,363 | 1/1976 | Schweizer | 280/632 |
| 3,954,277 | 5/1976 | Schweizer et al. | 280/631 |
| 4,103,930 | 8/1978 | Valoit | 280/631 |
| 4,183,549 | 1/1980 | Salomon | 280/632 |

FOREIGN PATENT DOCUMENTS

| | | | |
|---|---|---|---|
| 1248987 | 8/1967 | Fed. Rep. of Germany | 280/632 |
| 1428987 | 1/1969 | Fed. Rep. of Germany | 280/631 |
| 1428961 | 3/1969 | Fed. Rep. of Germany | 280/624 |
| 2500457 | 9/1975 | Fed. Rep. of Germany | 280/631 |
| 2433461 | 1/1976 | Fed. Rep. of Germany | 280/632 |
| 1906365 | 6/1976 | Fed. Rep. of Germany | 280/632 |
| 2456326 | 8/1976 | Fed. Rep. of Germany | 280/631 |

*Primary Examiner*—David M. Mitchell

[57] ABSTRACT

A ski safety binding of the type in which a sole clamp is pivotally mounted about a transverse pivot axis on a base plate and is retained in a closed position for clamping a ski boot by means of a spring loaded latch device. During safety release the sole clamp is able to pivot upwardly about the transverse axis to overcome the latching force. To allow the sole clamp to be readily opened by hand a pivotable hand opening lever is provided for relieving the spring loading of the latch device.

The latch device features a latch projection carried at one end of a pivoted latch lever which is spring loaded by a coil spring carried by the hand opening lever. The force of the spring is transmitted to the latch lever via a bar-like extension of a spring abutment which is displaceably arranged relative to the hand opening lever and which is pivotally connected to the latch lever about a further transverse pivot axis which defines the pivot axis for the hand opening lever. The force of the latch spring is reacted by a second latch device which constrains the position of the hand opening lever relative to the latch lever. On disengaging the second latch device by pulling the hand opening lever upwardly a sufficient mechanical advantage is available to readily overcome the force of the latch spring and the hand opening lever is free to move in a direction such that the force of the latch spring is no longer applied to the latch lever.

20 Claims, 10 Drawing Figures

SKI SAFETY BINDING

Figure 1:
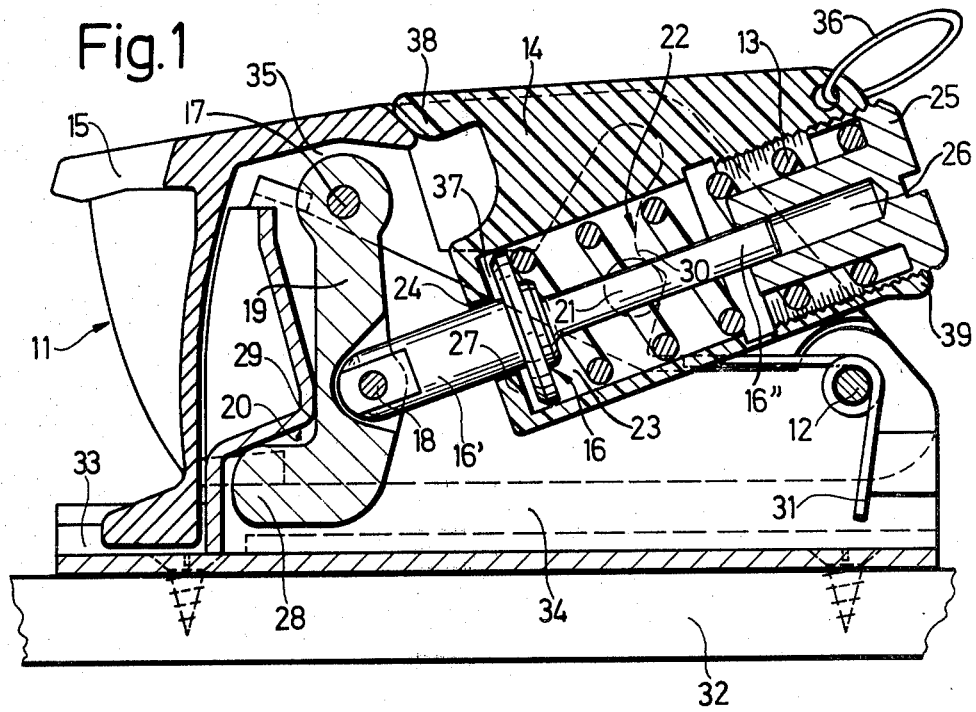

The invention relates to a ski safety binding and has particular reference to a ski safety binding of the kind incorporating a sole clamp which is upwardly pivotable about a transverse pivot axis and which is held in its position of use by a spring loaded latch device and is pivotable upwardly by overcoming the latching force. This situation arises when an excessive upward force is exerted on the sole clamp due to a fall experienced by a skier.

In a binding of this type there is frequently also provided a hand opening mechanism with a pivotable hand opening lever extending away from the sole clamp substantially in the longitudinal direction of the ski. The hand opening lever relieves the spring loading of the latch device on being pivoted in the opening direction thus enabling the sole clamp to be readily opened by upward pivotable movement so that the skier can simply step out of the binding. In the above described arrangement, and after pivoting of the hand opening lever in the opening direction, the latch spring is conveniently braced at both ends on the same component because of the operation of the second latch device. This arrangement allows the latching force to be removed entirely from the spring loaded latch device.

A ski safety binding of the kind set out above is known from DE-OS No. 2 432 711 in which the spring loaded latch device is defined by a latch lever pivotable about a transverse axis at the sole clamp and a cooperating latch part which is fixed relative to the ski. A detent which is loaded by the latch spring engages in a recess in the latch lever and presses the latch lever against the cooperating latch part which is fixed to the ski. The detent is axially displaceably arranged in a carrier and the extent of its axial displacement in the forward direction is limited. The carrier is pivotable about the same axis as the sole clamp. A special hand opening lever makes it possible to lift the carrier whereupon the detent comes out of its latch recess and is pressed by the latch spring against an end abutment of the carrier so that the latch lever is no longer loaded. The sole clamp can now be raised without having to overcome the latching force of the latching spring.

It is an advantage with the known binding that on opening by hand it is not necessary to overcome the entire force of the latching spring but rather only a fraction of this force because of the angled surface of the recess in which the detent engages. It is, however, a disadvantage of the known binding that it embodies numerous components and in particular requires a special carrier. The track on which the detent bears is limited by the length of the latch lever. Moreover, when opening the binding by hand the detent is loaded in a direction transverse to its direction of movement which leads to increased friction and greater wear.

A principal object of the present invention is to provide a safety ski bending of the kind previously mentioned which is of significantly simpler and more comprehensible construction and in which the loads on the individual components are kept as small as possible without having to forego the functional advantages of the binding system.

For satisfying this object the invention envisages a ski safety binding of the kind incorporating a sole clamp which is upwardly pivotable about a transverse pivot axis and which is held in its position of use by a spring loaded latch device and is pivotable upwardly by overcoming the latching force, there being further provided a hand opening mechanism with a pivotable hand opening lever extending away from the sole clamp substantially in the longitudinal direction of the ski, and which relieves the spring loading of the latch device on being pivoted in the opening direction so that the sole clamp can be readily opened by upward pivotable movement thereof; the arrangement being such that the latch spring, after pivoting of the hand opening lever in the opening direction, is braced because of the operation of a second latch device with both ends on the same component and characterized in that the latch spring is itself arranged at the hand opening lever and the associated spring abutment, which is disposed towards the sole clamp and is guided in the direction of the spring force is pivotably connected to a latch lever which is itself pivotable about a transverse axis and which together with a cooperating latch part forms the first latch device, and that the second latch device operates between the hand opening lever and the constructional element to which the latch lever is pivotably connected.

Thus, because of the arrangement of the latch spring at the hand opening lever itself it is possible to omit a special carrier for the latch spring. At the same time the construction in accordance with the invention allows the hand opening lever to extend from the pivot point on the latch lever away from the sole clamp so that it can be easily rotated by means of a safety strap or by engagement with the tip of a ski pole. On releasing the binding by hand the spring abutment and the parts associated with it are not loaded in directions transverse to the direction of movement so that corresponding frictional forces and the consequences of wear do not arise.

Because the second latch device operates between the hand opening lever and the component which carries the latch lever, the possibilities for arranging the latch device with respect to the distribution of forces and the operating paths during opening and closing are significantly enlarged.

It is especially advantageous if the latch spring is housed in a cylindrical chamber of the hand opening lever. In this case the hand opening lever is in the form of a single solid block which receives the latch spring in a manner such that it is completely protected from external influences.

The spring abutment advantageously has a bar-like extension in the direction towards the latch lever and which is pivotally connected to the latch lever. The bar-like extension extends through a bore at the end of the cylindrical chamber of the hand opening lever.

Preferably the spring abutment also has a second bar-like extension which extends in the opposite direction to the first and serves for axially guiding the spring abutment.

The other spring abutment which is provided at the hand opening lever is usefully formed by an adjustment screw screwthreaded into the hand opening lever. An axial guide channel for the second bar-like extension can usefully be provided in the adjustment screw.

The second latch device is, in accordance with the invention, so constructed that it allows the hand opening lever, no opening, to move sufficiently rearwardly that the first spring abutment comes into contact with an abutment of the hand opening lever and so that on further movement the latch lever is completely freed from its cooperating latch part without a compression. The second latch device must thus ensure a sufficient range of movement for the hand opening lever that the latch lever can pass the cooperating latch part at its apex point without resistance. With this arrangement the hand opening lever can be guided, during opening by the second latch device, away from the ski or also towards the ski.

The latch lever usefully carries a latch projection which cooperates with a cam track which forms the cooperating latch part and which preferably has an apex point so that after the apex point has been exceeded during a safety release an opening moment is exerted on the sole clamp.

The hand opening lever is advantageously provided with side disposed latch journals which cooperate with a latch track which limits the movement of the hand opening lever away from the sole clamp. The latch track likewise has an apex point between the closed position and the open position so that the hand opening lever remains safely in the closed position in the associated latch recess also in the case of a safety release. Only during hand opening does the latch journal snap out of the latch recess into the opening region of the latch track.

In order, for all adjustment ranges of the latch spring, to achieve a defined and constant latch resistance during hand release a first region of the latch track is advantageously shaped in an arc about a radius drawn from the pivot point of the hand opening lever on the latch lever. The latch resistance is not in this case applied by the latch spring itself during movement through the latch recess but rather by a special spring which secures the hand opening lever against self-opening.

In accordance with a first advantageous embodiment the latch lever is pivoted at its top to the sole clamp and cooperates with a cam track provided on a base member or fixedly located relative to the ski. A further possibility is that the latch lever is pivotally connected at its lower end to a base member or fixed relative to the ski and cooperates with a cam track fixed relative to the sole clamp.

In all cases the binding can be slidably arranged under the influence of a bias spring on a base plate which is itself adapted to be fastened to a ski. In this case the parts designated in this application as being fixed relative to the ski will be understood to be fixed to a base member or a base frame of the binding which is displaceable against the bias spring relative to the base plate.

Figure 2:
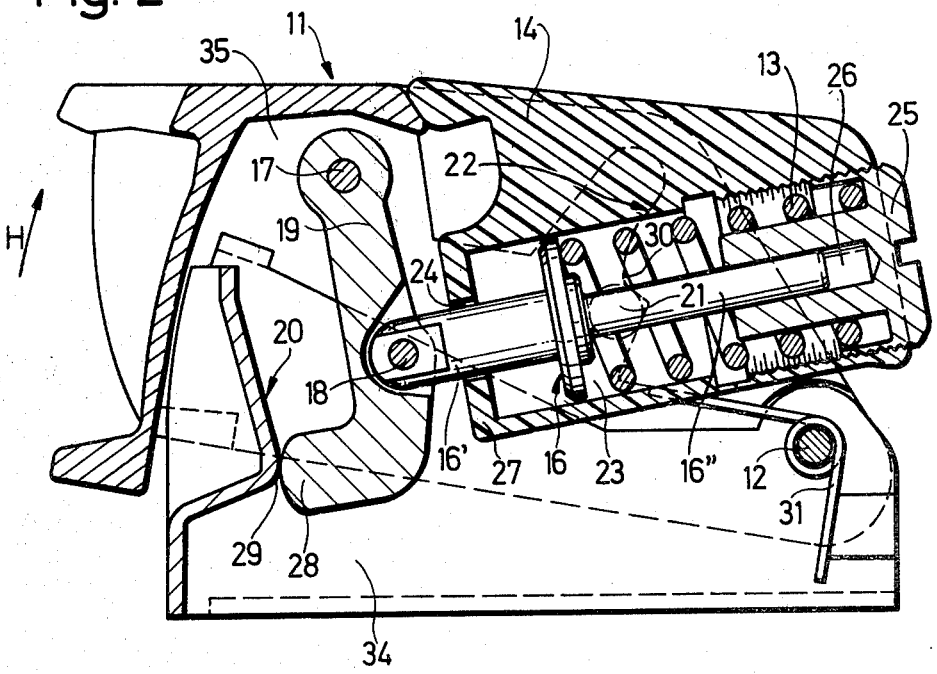
Figure 3:
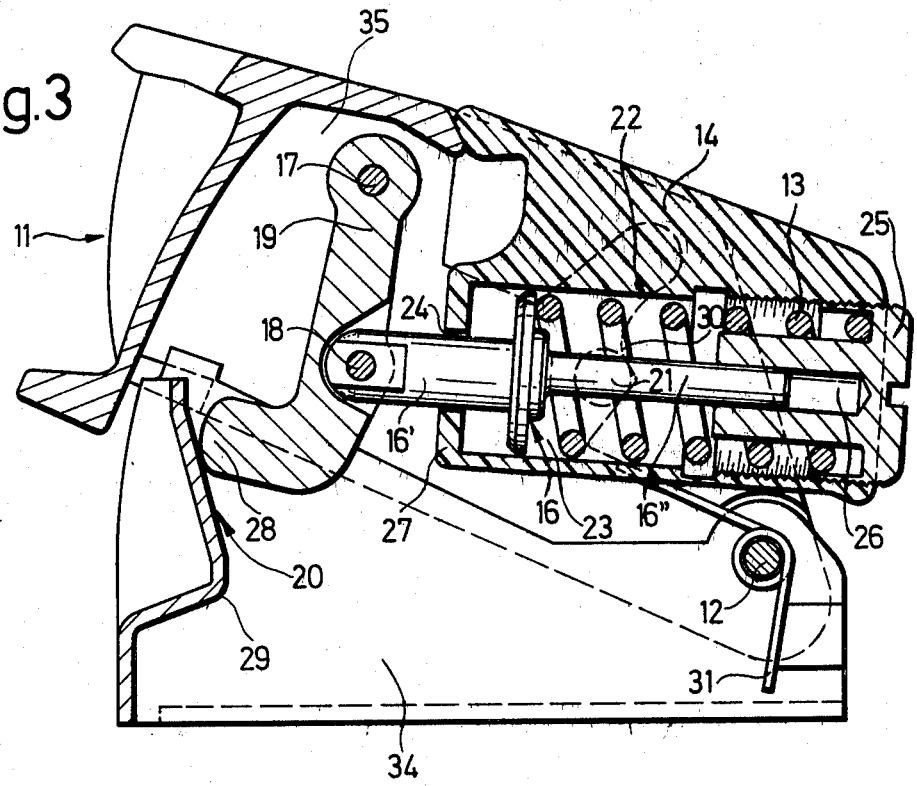
Figure 4:
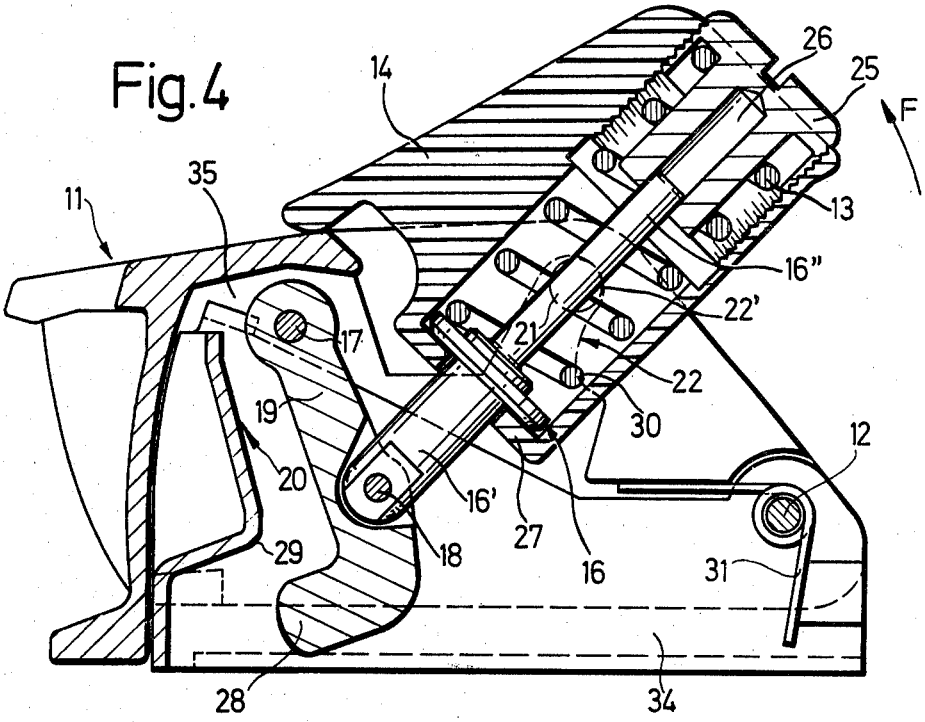
Figure 5:
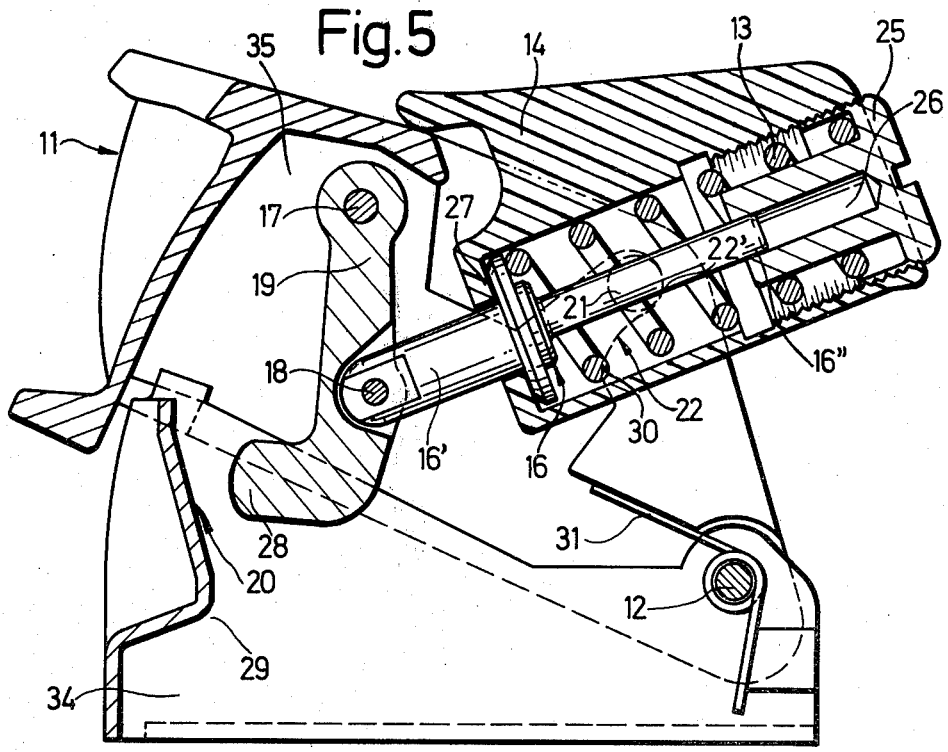
Figure 6:
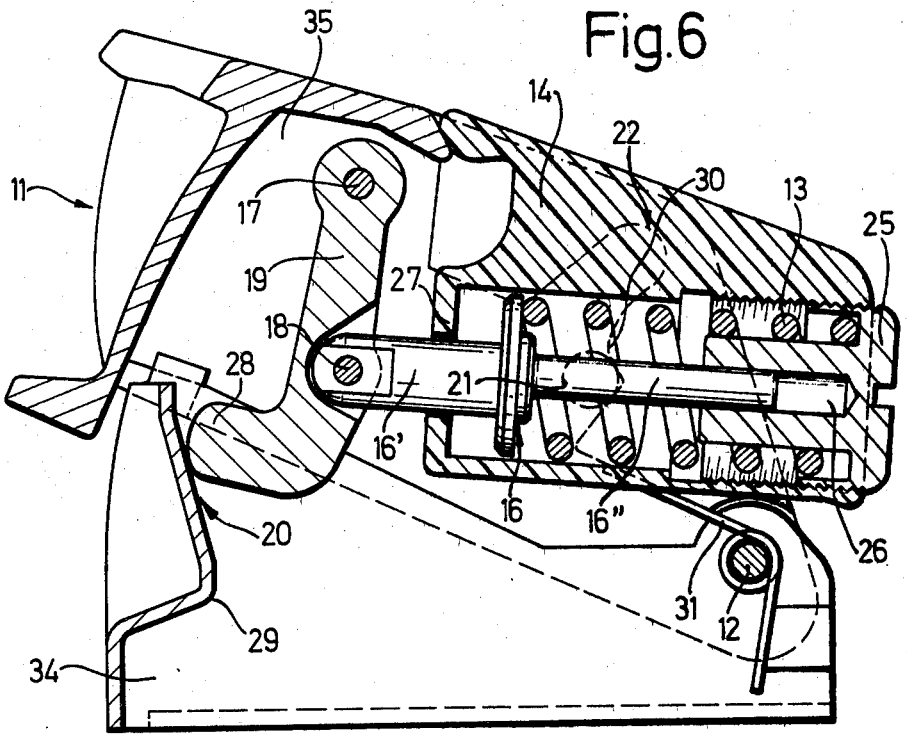
Figure 7:
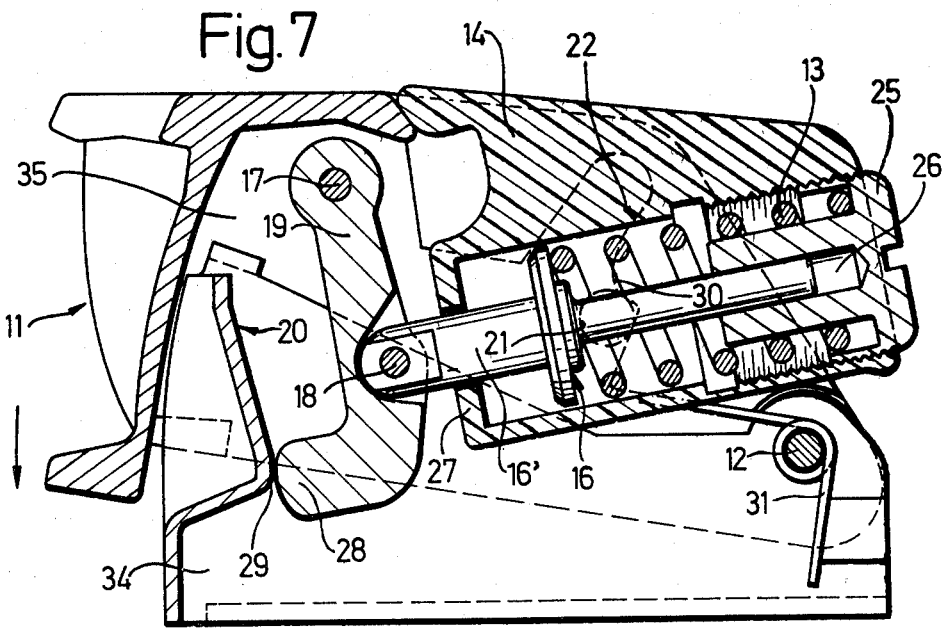
Figure 8:
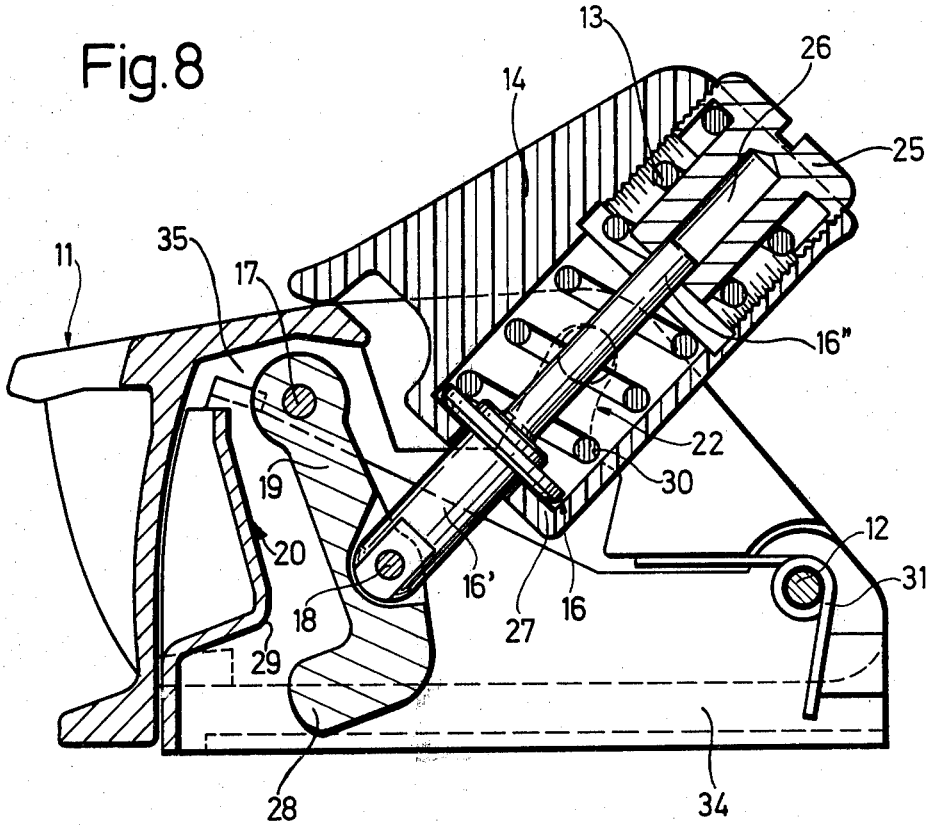
Figure 9:
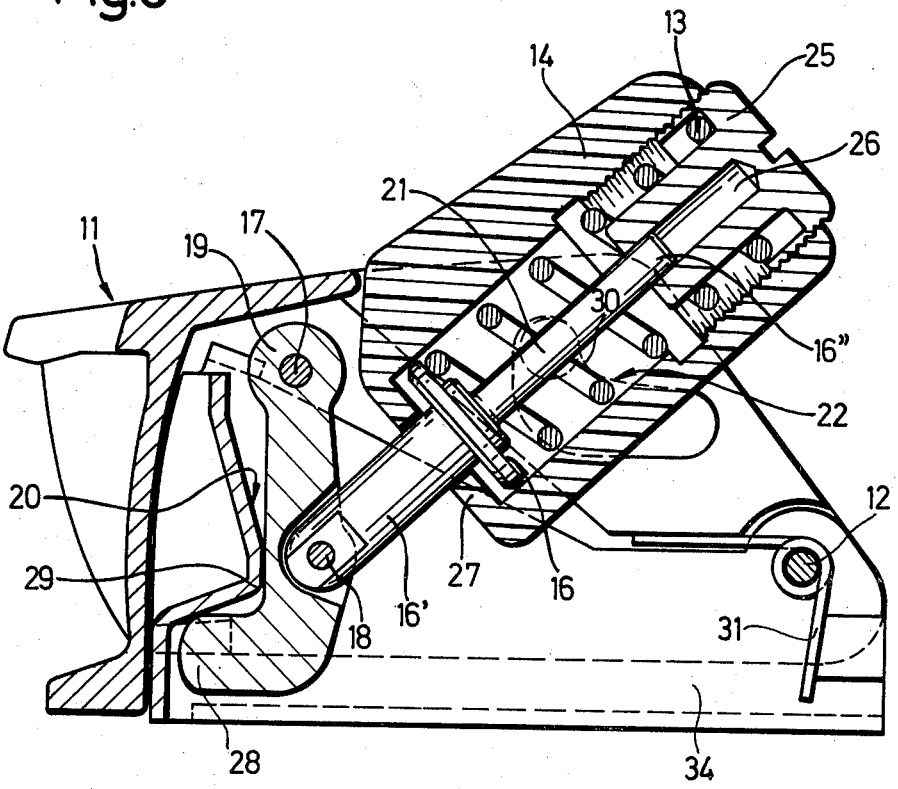
Figure 10:
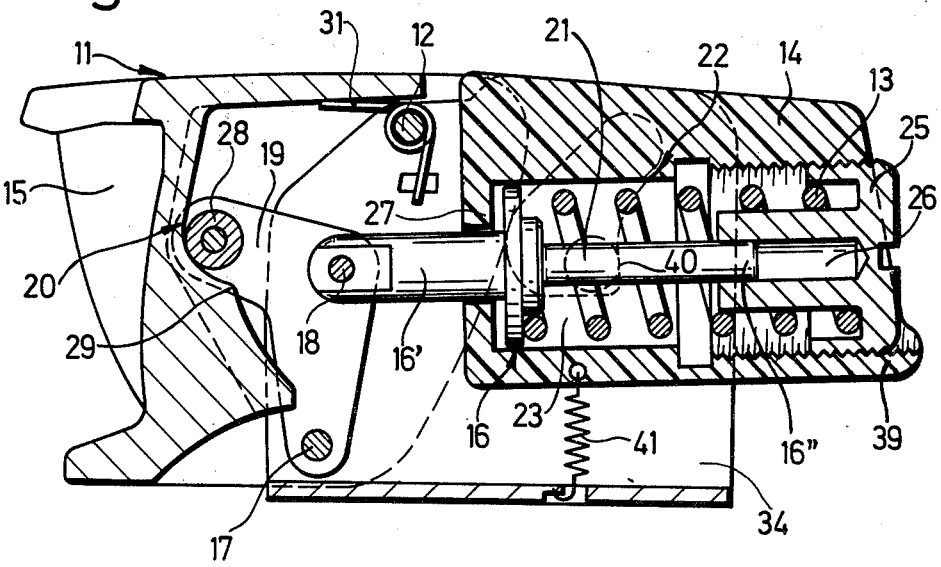

The invention will now be described in more detail and by way of example only with reference to the accompanying drawings which show:

FIG. 1 a partially sectioned side view of a safety ski binding in accordance with the invention and in the closed condition, FIG. 2 the same binding at a stage during opening thereof to effect safety release, FIG. 3 the same binding in its end position following safety release, FIG. 4 the same binding after a first phase of hand release in which the latch lever is completely retracted but, however, the sole clamp is still closed, FIG. 5 the same binding as illustrated in FIG. 4 but showing the sole clamp in the open position, FIG. 6 the same binding with the sole clamp in the open position, however, with the latch lever reset by closure of the hand opening lever, FIG. 7 the binding of FIG. 6 during depression of the sole clamp into the closed operative position, FIG. 8 the binding shown in the previous figures but this time with the sole clamp pressed into its closed position but with the hand opening lever still in the open position, FIG. 9 a partially sectioned side view of a further embodiment of a ski safety binding in accordance with the invention but showing a hand opening lever which projects away from the ski in the closed condition and FIG. 10 a partially sectioned side view of a further embodiment of a ski safety binding in accordance with the invention and in the closed condition.

As seen in FIG. 1 a base plate 33 is fastened to a ski which is schematically illustrated at 32 and a binding housing 34 is rearwardly displaceably arranged on the base plate against the force of a bias spring which is not shown but in manner well known per se. The particular housing illustrated is a heel binding.

A sole clamp 11 is arranged on the binding housing 34 for upward pivotal movement about a rearwardly disposed transverse axis 12. A latch lever 19 is pivotably attached at its upper end about a transverse axis 17 in a cavity 35 of the sole clamp and extends generally downwardly. At its lower end the latch lever 19 has a latch projection 28 which engages with a cam track 20 which forms a cooperating latch part and has an apex point 29.

A bar-like extension 16′ of a spring abutment 16 is pivotably connected about a transverse axis 18 to the rear side of the latch lever 19. The spring abutment 16 is located in a preferably cylindrical space within a hand opening lever 14 to which an opening force can be applied in the upward direction e.g. by means of a loop 36. The hand opening lever can, however, also be drawn into the open position by grasping the projection 39 by hand or pulling on it by means of a ski pole. In the closed position illustrated in FIG. 1 the spring abutment 16 has a small clearance 37 from an abutment 27 of the hand opening lever.

The end of the spring abutment 16 remote from the abutment 27 is loaded by a coil compression spring which is braced at its other end on an adjustment screw 25 which is screwthreaded into the space 23. The adjustment screw 25 is provided with a central guide channel or bore 26 into which there projects a further bar-like extension 16″ of the spring abutment 16. The extension 16″ is arranged to slide relative to the guide channel 26 in the adjustment screw.

The hand opening lever 14 which is constructed as a solid or unitary component has latch journals 21 at both sides which cooperate with respective latch tracks 22 provided on the sole clamp 11. The latch track 22 is formed as a profiled cam track and likewise has an apex point 30. The latch track 22 limits in this embodiment the movement of the hand opening lever 14 away from the sole clamp point 15 which is brought about by the spring 13. The bar-like extension 16′ extends through an opening 24 in the abutment 27 towards the latch lever 19.

A hair pin spring 31 provided in the region of the pivot axis 12 exerts a weak opening moment on the sole clamp 11.

In order that the interior of the ski safety binding is protected from external influences it is completely covered relative to the exterior by forming the region 38 of a soft elastic material or by sealing the gap between the sole clamp 11 and the hand opening lever 14 with a sealing lip.

The arrangement and dimensioning of the individual components with respect to one another which is essential for practicing the invention can be seen from the following description of the function of the binding as illustrated in FIGS. 1 to 9.

In the closed position shown in FIG. 1 in which a ski boot which is not illustrated is fixedly held or clamped to the ski the latch spring 13 presses the latch projection 28 of the latch lever 19 via the bar-like extension 16' against the cam track 20 with a force which is sufficient that the ski boot is reliably retained. The spring 13 is braced via the other abutment 25 via the hand opening lever 14 and the latch journals 21 of the second latch device against the latch recess of the latch track 22 the form of which is shaped to suit the preferably cylindrical latch journals 21. The reaction force is transmitted via the sole clamp 11 and the pivot axis 12 to the base member of the binding housing 34.

If now a release force acts in the direction of the arrow H of FIG. 2 on the sole clamp 11 the latch lever 19 can be displaced upwardly along the cam track 20 past the apex point 29 whilst compressing the latch spring 13. At the moment the latch lever passes the apex point 29 the closure force converts into an opening force, because of the inclination of the other part of the cam track beyond the apex point, and the sole clamp snaps into the opening position which can be seen in FIG. 3. Closing the binding from this position takes place simply by pressing the sole clamp downwardly into the position of FIG. 1. This can e.g. take place when a skier steps back into his binding.

If it is desired to open the binding by hand then this is carried out for this embodiment by exerting a force in the direction F of FIG. 4 on the hand opening lever 14. The latch journals 21 of the hand opening lever can be moved with a relatively small force out of the latch recess in which they are located in the closed position of FIG. 1, by reason of the profile or inclination of the latch track 22 which is chosen to be not too large. It will be appreciated that the mechanical advantage of the hand opening lever which results in the ability to open the binding by hand without excessive effort is determined by the profile and disposition of the latch track 22 in relation to the pivot point 18. Thus the spring 13 is somewhat compressed until the apex point 30, which is not very high, is reached. As soon as the apex point 13 is exceeded the spring abutment 16 first of all contacts the abutment 27 of the hand opening lever because the fall in the profile of the latch track is correspondingly dimensioned at the region 22. The latch journals 21 can now move within the region 22 sufficiently far that the latch lever 19, in accordance with FIG. 4, is sufficiently far removed from the cam track 20 that the subsequent upwards movement of the sole clamp in accordance with FIG. 5 allows the latch projection 28 to move upwardly without contacting the cam track 20. The opening movement of the sole clamp 11 from the position of FIG. 4 into the open position of FIG. 5 is brought about by the correspondingly dimensioned hair pin spring 31.

The closure of the binding from the position of FIG. 5 can now take place in either of two ways.

In the first instance and as illustrated in FIG. 6 the hand opening lever 14 is depressed so that the latch journals 21 once more snap into their associated latch recesses defining the closed position. At this stage the binding is in the position shown in FIG. 3 corresponding to the position prevailing after safety release and it can be closed from this position simply by depressing the sole clamp. An intermediate stage of this closure movement is illustrated in FIG. 7.

It is, however, also possible as shown in FIG. 8 to first of all close the sole clamp by inserting the ski boot into the binding and then e.g. by means of the ski pole or by hand to depress the hand opening lever into its latched operational position.

The embodiment of FIG. 9 corresponds to the embodiment of FIG. 1 apart from the arrangement of the hand opening lever 14 in its closed and open positions. In the closed position the hand opening lever extends away from the ski 14 so that the hand opening lever has to be depressed towards the ski to release the binding by hand.

In the embodiment of FIG. 10 the latch lever 19 is connected at its lower end at a pivot 17 to a part which is fixed relative to the housing or base member 34. The cam track 20 is constructed on the inside of the sole clamp 11. In this embodiment the latch track 22 is also provided on side plates which are fixed to the housing 34. The latch track 22 has in this embodiment no latch recess for the closed position of the latch journals 21 but rather a first region 40 which corresponds approximately to an arc with a radius drawn about the pivot point 18 of the hand opening lever 14 on the latch lever 19. The hand opening lever 14 is in this case secured against self-opening by a tension spring 41 which is pivotably attached to a mounting fixed relative to the ski. On opening the binding by hand this arrangement of the second latch device means that in all adjustment ranges of the latch spring 13 it is only necessary to overcome a defined and always constant resistance of the tension spring 41. This latch device can also be used in the previously shown embodiments. The spring 41 must, however, then be connected to the sole clamp 11. In other respects the operation of the embodiment of FIG. 10 is the same as that of the first embodiment.

It will be appreciated by those skilled in the art that a number of modifications are possible to the embodiments herein described without departing from the scope of the present teaching. For example, it is contemplated that the latch tracks which are described as being defined by the perimeters of apertures formed either in the sole clamp or side plates of the base member can also be defined by peripheral edges of simple recesses formed in these components. Furthermore, the binding can incorporate parts of plastic, e.g. made by injection moulding.

In the preferred embodiments the spring abutment 16 contacts the abutment 27 on the hand opening lever following opening movement thereof. In this position the latch spring is braced at both ends on the same component namely the hand opening lever. It will however be appreciated that contact between the spring abutment 16 and the hand opening lever at 27 is not essential to the functioning of the binding. It would for example be possible to leave sufficient space for the spring to fully expand and to arrange the second latch device so that, on opening, the hand opening lever can move sufficiently rearwardly that the latching force on the latch lever is relieved.

The latch journals on the hand openin lever are preferably of cylindrical form but can usefully be in the form of cylindrical sleeves journalled on stub pivots. This is useful in further reducing friction at the second latch device and is particularly applicable to the embodiment of FIG. 10.

I claim:

1. A ski safety binding comprising a sole clamp member, a base member, transverse pivot axle means mounting said sole clamp member on said base member for movement between a closed, ski boot retaining position and an open, ski boot releasing position, first latch means for retaining said sole clamp in said closed position and including a latch lever, transverse pivot means for pivotally mounting said latch lever on one of said members and a cooperating latch part provided on the other member, the binding further comprising spring means having first and second ends for biasing said latch lever into engagement with said cooperating latch part in said closed position of said sole clamp member to generate a latching force, a hand opening lever carrying said spring means, and means pivotally mounting said hand opening lever on said latch lever, said last mentioned means being slidably movable relative to said hand opening lever and forming an abutment for said first end of said spring means with said second end of said spring means bearing on said hand opening lever, said hand opening lever extending away from said sole clamp members substantially in the longitudinal direction of the binding and being movable between a first position in which said spring means bears on said latch lever via said abutment and a second position in which said abutment bears on stop means of said hand opening lever thereby removing said latching force, and wherein second latch means is provided, said second latch means operating between said hand opening lever and the member on which said latch lever is pivotally mounted for releasably retaining said hand opening lever in said first position.

2. A ski safety binding according to claim 1 and wherein said hand opening lever has a cylindrical chamber with said spring means being carried in said cylindrical chamber.

3. A ski safety binding according to claim 1 and wherein said means pivotally mounting said hand opening lever on said latch lever comprises a first bar-like extension extending from said abutment to said latch lever.

4. A ski safety binding in accordance with claim 3 and wherein said means pivotally mounting said hand opening lever on said latch lever includes a bar-like guide extension for axially guiding said abutment relative to said hand opening lever.

5. A ski safety binding in accordance with claim 1 and wherein said second end of said spring means bears on an adjustment screw, screw-threaded into said hand opening lever.

6. A ski safety binding in accordance with claim 4 and wherein said second end of said spring means bears on an adjustment screw screw-threaded into said hand opening lever, said adjustment screw including an axial guide channel for guiding said bar-like guide extension.

7. A ski safety binding in accordance with claim 1 and wherein said second latch means comprises a profiled cam track having first and second portions said first portion permitting movement of said hand opening lever until said abutment bears on said stop means, and a second portion permitting further movement of said hand opening lever until said latch lever is completely free from its cooperating latch part.

8. A ski safety binding in accordance with claim 7 and wherein said second latch means acts to guide said hand opening lever away from the ski during movement from said first position to said second position.

9. A ski safety binding in accordance with claim 7 and wherein said second latch means acts to guide said hand opening lever towards the ski on movement from said first position to said second position.

10. A ski safety binding in accordance with claim 1 and wherein said latch lever carries a latch projection which cooperates with a cam track forming said cooperating latch part.

11. A ski safety binding in accordance with claim 10 and wherein said cam track has an apex point.

12. A ski safety binding in accordance with claim 1 and wherein said hand opening lever has side disposed latch journals which each cooperate with a respective latch track to define said second latch means with said latch tracks limiting the movement of said hand opening lever.

13. A ski safety binding according to claim 12 and wherein each said latch track has an apex point between said first and second positions.

14. A ski safety binding in accordance with claim 12 and wherein said means pivotally mounting said hand opening lever on said latch lever defines a pivot axis for pivotal movement of said hand opening lever relative to said latch lever and wherein each said latch track has a first region which is profiled to correspond substantially to an arc drawn about said pivot axis.

15. A ski safety binding in accordance with claim 14 and wherein said hand opening lever is secured against self-opening by a spring.

16. A ski safety binding in accordance with claim 1 and wherein said transverse pivot means is provided at an upper end of said sole clamp and said cooperating part comprises a cam track fixedly located on said base member.

17. A ski safety binding in accordance with claim 1 and wherein said transverse pivot means pivotally mounts said latch lever on said base member and said cooperating latch part comprises a cam track fixedly located on said sole clamp.

18. A ski safety binding in accordance with claim 1 and wherein a hair pin spring is provided, with said hair pin spring biasing the sole clamp towards said open position whereby said sole clamp opens on removal of said latching force.

19. A safety ski binding comprising a sole clamp member, a base member, transverse pivot axle means mounting said sole clamp member for pivotal movement relative to said base member between a closed position and an open position, cooperating latch parts defining first latch means and including a latch lever pivotally mounted on one of said members, and spring means associated with said latch lever for generating a latching force to secure said sole clamp member in said closed position while allowing pivotal movement of said sole clamp member towards said open position against said latching force on the occurrence of excessive forces, said binding further comprising a hand opening lever for relieving said latching force, and the arrangement being such that the spring means comprises a spring and a spring abutment carried by said hand opening lever for movement together therewith, means pivotally connecting said spring abutment to said latch lever and defining a pivot axis for pivotal movement of said hand opening lever, and second latch means comprising cooperating latch parts on the hand opening lever and other structure of said binding, said second latch means being operative to releasably retain said hand operating lever in a first position in which said latching force is transmitted to said latch lever and to permit movement of said hand operating lever to a second position in which said latching force is relieved.

20. A safety ski binding comprising a base member, a sole clamp member pivotally mounted about a first transverse axis on the base member for movement between an open position and a closed position, a first latch device including a latch lever pivotally mounted on one of said members and engageable, in the closed position of the binding, with a cooperating latch part provided on the other member, spring means for biasing said latch lever into engagement with said cooperating latch part, a hand opening lever for relieving the bias spring means to facilitate movement of said sole clamp member between said open and closed positions, a second latch device disposed between said hand opening lever and the member on which said latch lever is pivotally mounted, with said second latch device permitting movement of said hand opening lever from a first latched position to a second unlatched position in which it is operative to relieve the bias of said spring, and wherein said spring means has a first end bearing against said hand opening lever and a second end bearing against an abutment member, with said abutment member being guided by said hand opening lever for sliding movement relative thereto and being pivotally connected to said latch lever, whereby to transmit the bias of said spring means to said latch lever and to mount said hand opening lever for pivotal movement relative to said latch lever.

* * * * *